US006625823B1

(12) United States Patent
Abbott

(10) Patent No.: US 6,625,823 B1
(45) Date of Patent: Sep. 30, 2003

(54) DISPOSABLE WASTE CONTAINER FOR A POTTY-CHAIR

(76) Inventor: Brian K. Abbott, 465 Greenlee Rd., Seaman, OH (US) 45679

( * ) Notice: Subject to any disclaimer, the term of this patent is extended or adjusted under 35 U.S.C. 154(b) by 0 days.

(21) Appl. No.: 10/051,997

(22) Filed: Jan. 22, 2002

(51) Int. Cl.[7] ..... A47K 11/06

(52) U.S. Cl. ..... 4/484; 4/483; 4/144.2; 4/DIG. 5

(58) Field of Search ..... 4/144.1, 144.2, 4/300.3, 451, 452, 460, 479, 483, 484, DIG. 5

(56) References Cited

U.S. PATENT DOCUMENTS 3,061,840 A * 11/1962 Presseisen ..... 4/451
3,540,433 A * 11/1970 Brockman ..... 4/144.1
4,856,666 A * 8/1989 Easley ..... 215/272
6,112,339 A * 9/2000 Nichols et al. ..... 4/484

FOREIGN PATENT DOCUMENTS

GB 2248180 A * 4/1992 ..... 4/484

* cited by examiner

*Primary Examiner*—Tuan N. Nguyen

(57) ABSTRACT

A disposable waste container for a potty-chair for allowing easy cleanup and quick disposal of waste material from a potty-chair. The disposable waste container for a potty-chair includes a bag member having an opening therein and being adapted to be removably disposed in and to line a waste receptacle of a potty-chair; and also includes a flange-like collar being securely attached along an edge of the opening of the bag member and being adapted to removably rest upon a seat of the potty-chair; and further includes a bag closure member.

2 Claims, 4 Drawing Sheets

DISPOSABLE WASTE CONTAINER FOR A POTTY-CHAIR

BACKGROUND OF THE INVENTION

1. Field of the Invention

The present invention relates to potty-chair disposable waste containers and more particularly pertains to a new disposable waste container for a potty-chair for allowing easy cleanup and quick disposal of waste material from a potty-chair.

2. Description of the Prior Art

The use of potty-chair disposable waste containers is known in the prior art. More specifically, potty-chair disposable waste containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,061,840; U.S. Pat. No. 4,882,794; U.S. Pat. No. 4,759,086; U.S. Pat. No. 5,455,972; U.S. Pat. No. 3,475,767; and U.S. Pat. No. Des. 354,342.

While these devices fulfill their respective, particular objectives and requirements, the aforementioned patents do not disclose a new disposable waste container for a potty-chair. The inventive device includes a bag member having an opening therein and being adapted to be removably disposed in and to line a waste receptacle of a potty-chair; and also includes a flange-like collar being securely attached along an edge of the opening of the bag member and being adapted to removably rest upon a seat of the potty-chair; and further includes a bag closure member; and conveniently separates the liquid waste from the solid waste, and eliminates the user having to clean the waste receptacle of the potty-chair.

In these respects, the disposable waste container for a potty-chair according to the present invention substantially departs from the conventional concepts and designs of the prior art, and in so doing provides an apparatus primarily developed for the purpose of allowing easy cleanup and quick disposal of waste material from a potty-chair.

SUMMARY OF THE INVENTION

In view of the foregoing disadvantages inherent in the known types of potty-chair disposable waste containers now present in the prior art, the present invention provides a new disposable waste container for a potty-chair construction wherein the same can be utilized for allowing easy cleanup and quick disposal of waste material from a potty-chair.

The general purpose of the present invention, which will be described subsequently in greater detail, is to provide a new disposable waste container for a potty-chair apparatus and method which has many of the advantages of the potty-chair disposable waste containers mentioned heretofore and many novel features that result in a new disposable waste container for a potty-chair which is not anticipated, rendered obvious, suggested, or even implied by any of the prior art potty-chair disposable waste containers, either alone or in any combination thereof.

There has thus been outlined, rather broadly, the more important features of the disposable waste container for a potty-chair in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new disposable waste container for a potty-chair apparatus and method which has many of the advantages of the potty-chair disposable waste containers mentioned heretofore and many novel features that result in a new disposable waste container for a potty-chair which is not anticipated, rendered obvious, suggested, or even implied by any of the prior art potty-chair disposable waste containers, either alone or in any combination thereof.

Still another object of the present invention is to provide a new disposable waste container for a potty-chair for allowing easy cleanup and quick disposal of waste material from a potty-chair.

Still yet another object of the present invention is to provide a new disposable waste container for a potty-chair that is easy and convenient to use.

Even still another object of the present invention is to provide a new disposable waste container for a potty-chair that maintains cleanliness and sanitation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
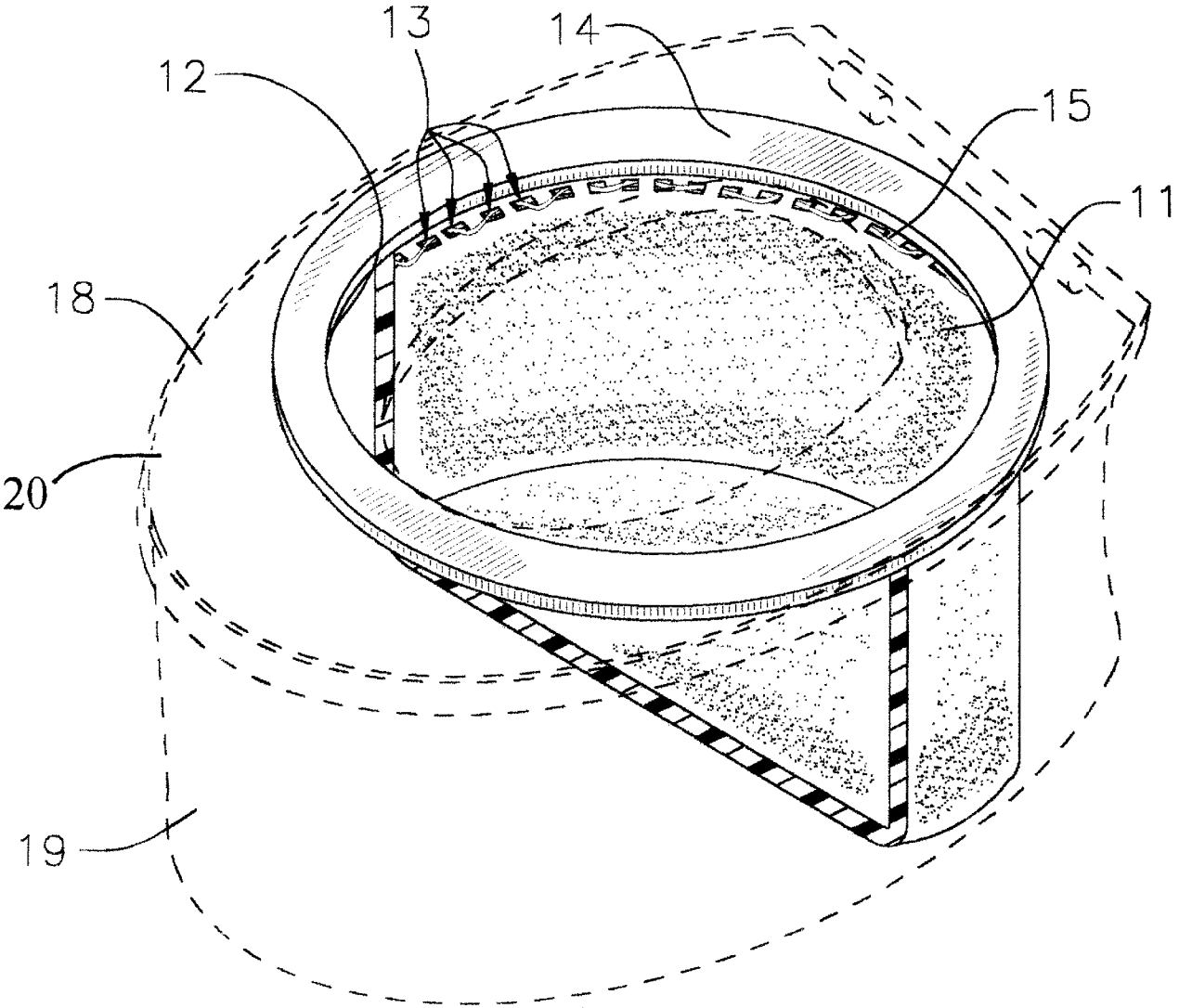
FIG. 1 is a perspective view of a new disposable waste container for a potty-chair according to the present invention and shown in use.
Figure 2:
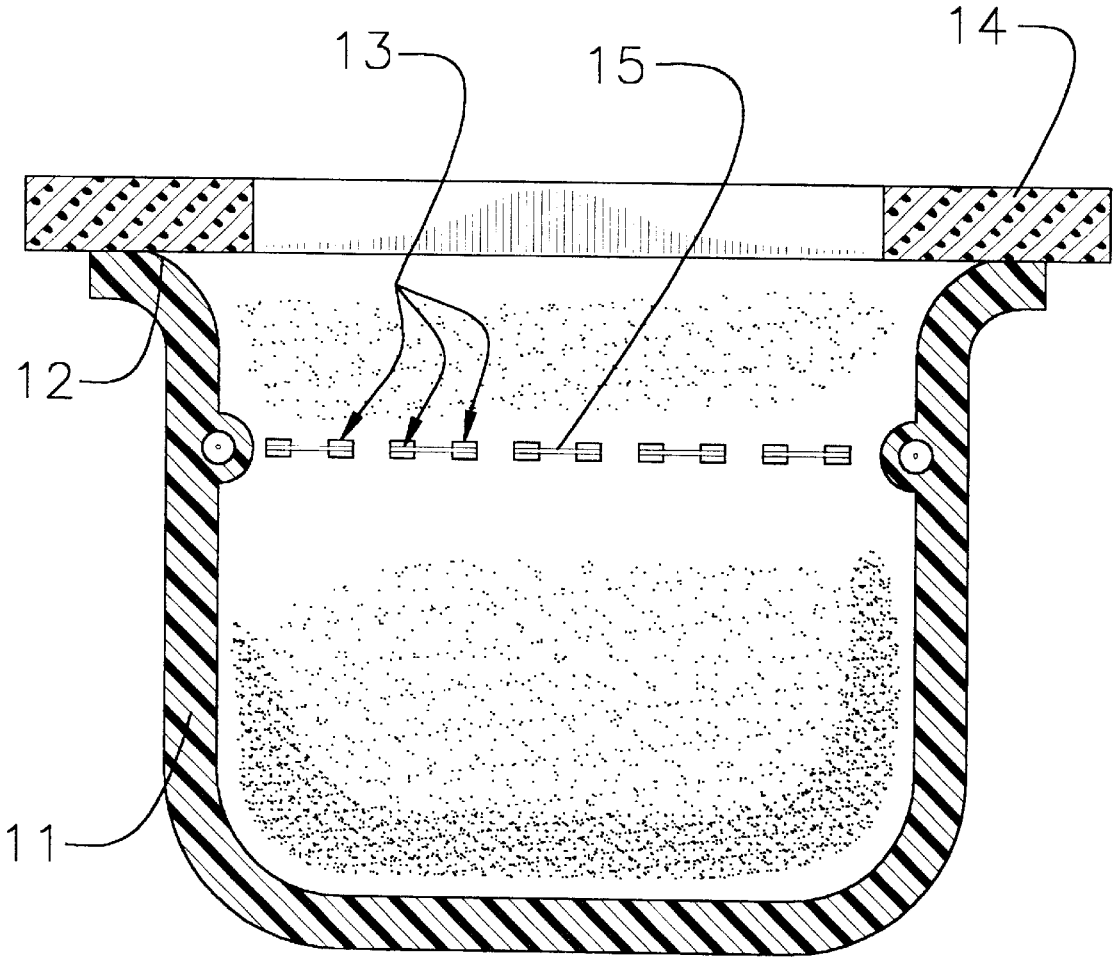
FIG. 2 is a cross-sectional view of the present invention.
Figure 3:
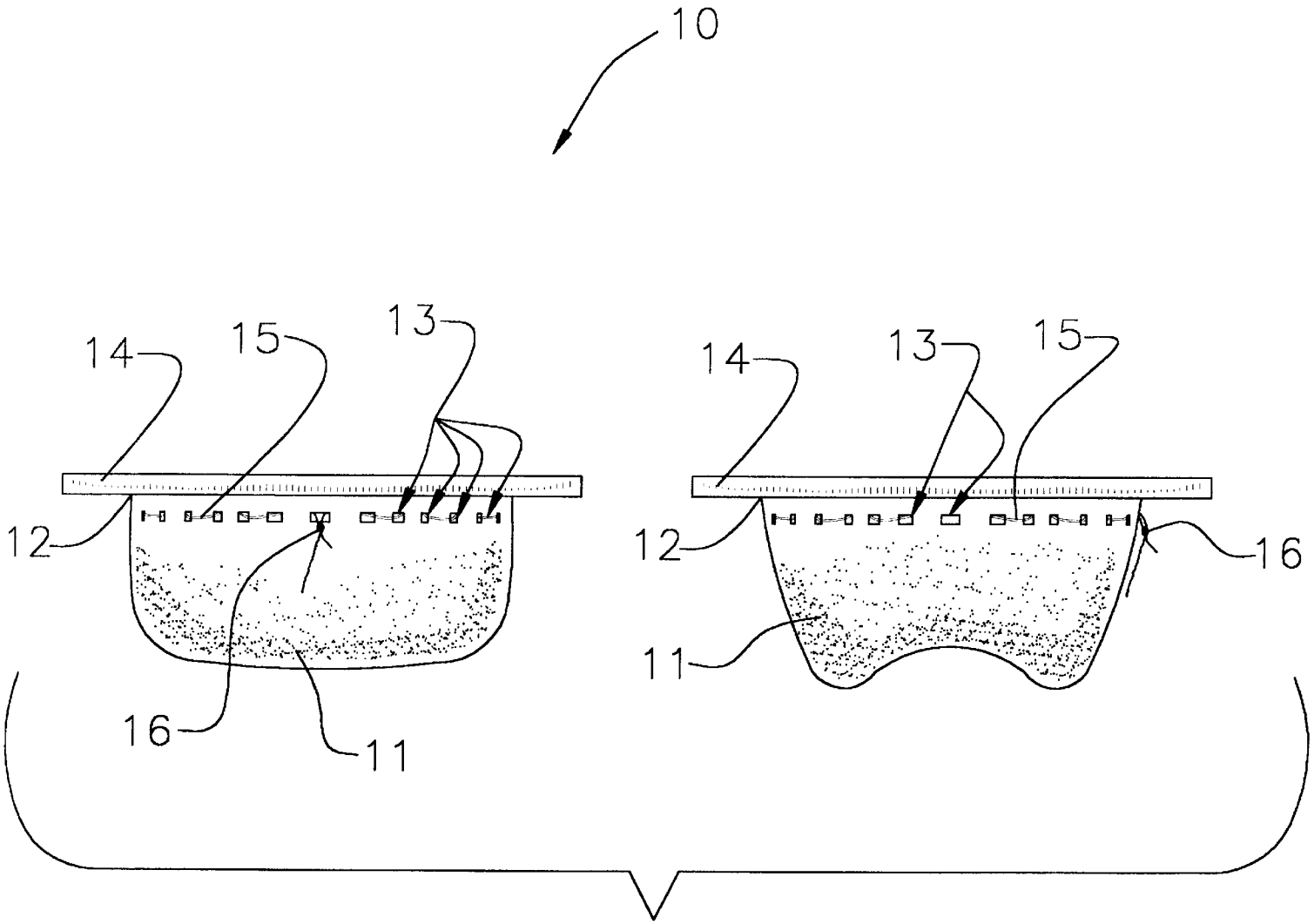
FIG. 3 is a side elevational view of the present invention.
Figure 4:
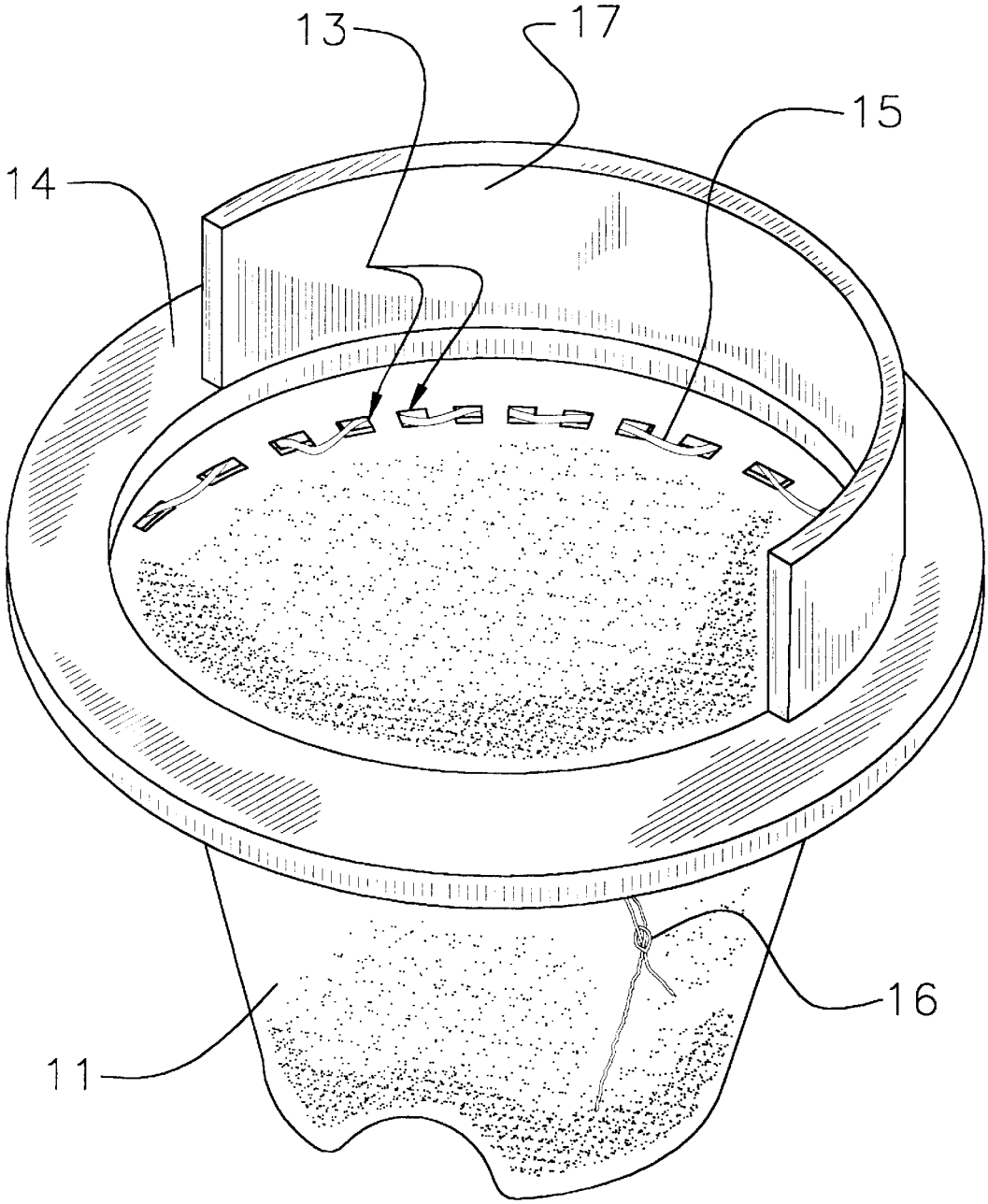
FIG. 4 is a perspective view of a second embodiment of the present invention.

With reference now to the drawings, and in particular to FIGS. 1 through 4 thereof, a new disposable waste container for a potty-chair embodying the principles and concepts of the present invention and generally designated by the reference numeral 10 will be described.

As best illustrated in FIGS. 1 through 4, the disposable waste container for a potty-chair 10 generally comprises a bag member 11 having an opening therein and being adapted to be removably disposed in and to line a waste receptacle 19 of a potty-chair 18. The bag member 11 has a plurality of perforations 13 spacedly disposed through a wall and near the opening of the bag member 11. The bag member 11 is made of absorbent material capable of absorbing liquid waste to separate the liquid waste from the solid waste.

A flange-like collar 14 is securely and conventionally attached along an edge 12 of the opening of the bag member 11 and is adapted to removably rest upon a seat 20 of the potty-chair 18. The flange-like collar 14 is a thin flexible annular strip of material being adapted to cover at least a portion of the seat 20.

A means for closing the bag member 11 includes a drawstring member 15,16 having a string 15 being wound through the perforations 13 and also having a tie member 16 for tightening and closing the string 15 about the bag member 11.

A splatter guard member 17 is securely, conventionally, and perpendicularly attached to the flange-like collar 14. The splatter guard member 17 is an arcuate panel extending upwardly and outwardly along a rear portion of the edge 12 of the opening of the bag member 11.

In use, the bag member 11 is placed in the waste receptacle 10 of the potty-chair 18 with the flange-like collar 14 being disposed upon the seat 20 of the potty-chair 18 to support the bag member 11. After the potty-chair 18 is used, the bag member 11 is closed using the drawstring member 15,16, and the bag member 11 is removed from the waste receptacle 19 and disposed of, and a new bag member 11 is placed in the waste receptacle 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the disposable waste container for a potty-chair. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable waste container for a potty-chair comprising:

a bag member having an opening therein and being adapted to be removably disposed in a waste receptacle of a potty-chair, said bag member having a plurality of perforations spacedly disposed through a wall and near said opening of said bag member;

a flange-like collar being securely attached along an edge of said opening of said bag member and being adapted to removably rest upon a seat of the potty-chair;

a means for closing said bag member including a drawstring member having a string being wound through said perforations and also having a tie member for tightening and closing said string about said bag member; and a splatter guard member being securely and perpendicularly attached to said flange-like collar.

2. The disposable waste container for a potty-chair as described in claim 1, wherein said splatter guard member is an arcuate panel extending upwardly and outwardly along a rear portion of said edge of said opening of said bag member.

* * * * *